US008113217B2

(12) United States Patent
Grzonka

(10) Patent No.: US 8,113,217 B2
(45) Date of Patent: Feb. 14, 2012

(54) FILTER TIP CIGARETTES AND METHOD OF MANUFACTURING SAME

(75) Inventor: Horst Grzonka, Mistelgau (DE)

(73) Assignee: British American Tobacco (Investments) Limited, London (GB)

( * ) Notice: Subject to any disclaimer, the term of this patent is extended or adjusted under 35 U.S.C. 154(b) by 1259 days.

(21) Appl. No.: 10/523,772

(22) PCT Filed: Aug. 7, 2003

(86) PCT No.: PCT/GB03/03430
§ 371 (c)(1),
(2), (4) Date: Dec. 6, 2005

(87) PCT Pub. No.: WO2004/014161
PCT Pub. Date: Feb. 19, 2004

(65) Prior Publication Data

US 2006/0102188 A1 May 18, 2006

(30) Foreign Application Priority Data

Aug. 9, 2002 (DE) ..... 102 36 655

(51) Int. Cl.
*A24D 1/16* (2006.01)

(52) U.S. Cl. ..... 131/365; 131/361; 131/284; 131/342

(58) Field of Classification Search ..... 131/365, 131/336, 342, 284; 156/244.12
See application file for complete search history.

(56) References Cited

U.S. PATENT DOCUMENTS 3,637,447 A * 1/1972 Berger et al. ..... 156/180
4,040,430 A * 8/1977 Molins ..... 131/94
4,326,543 A * 4/1982 Martin et al. ..... 131/362
4,387,728 A 6/1983 Reynolds et al.
4,499,912 A * 2/1985 Berger ..... 131/336
4,552,158 A 11/1985 Berger
4,675,064 A * 6/1987 Berger ..... 156/244.12
4,784,163 A * 11/1988 Adams et al. ..... 131/284

(Continued)

FOREIGN PATENT DOCUMENTS

DE 814721 8/1951

(Continued)

OTHER PUBLICATIONS

Rofin—Lasers for Industry. "Applications MICRO: Perforating Perforations." 2009. http://www.rofin.com/index-fe.htm?start=/english/applications/laser-micro/perforating-perforation/index.php.*

(Continued)

*Primary Examiner* — Philip Tucker
*Assistant Examiner* — Vicki Wu
(74) *Attorney, Agent, or Firm* — Charles I. Sherman; Middleton Reutlinger

(57) ABSTRACT

The invention relates to a filter-tip cigarette with a tobacco rod (1) wrapped in a cigarette paper and a filter (6) wrapped along its length in tipping paper (4) or other wrapper being other than plugwrap, and a strip of material (5) fully covering the tipping paper of the filter and the cigarette paper of the wrapped tobacco rod in the region of the abutment between tobacco rod and filter bonds together the filter and tobacco rod. In addition, the invention relates to a process for the manufacture of such a filter, which may also be employed for the manufacture of 'double unit cigarettes'.

20 Claims, 3 Drawing Sheets

U.S. PATENT DOCUMENTS

| | | | | | |
|---|---|---|---|---|---|
| 4,809,718 | A | * | 3/1989 | Deal | 131/336 |
| 4,998,541 | A | * | 3/1991 | Perfetti et al. | 131/336 |
| 5,595,196 | A | * | 1/1997 | Salonen et al. | 131/362 |
| 5,662,126 | A | | 9/1997 | Charlton et al. | |
| 5,722,433 | A | * | 3/1998 | Ishino et al. | 131/365 |
| 5,819,751 | A | * | 10/1998 | Barnes et al. | 131/194 |
| 6,067,995 | A | * | 5/2000 | Schneider et al. | 131/360 |
| 6,302,114 | B1 | | 10/2001 | Clarke et al. | |
| 6,718,989 | B1 | * | 4/2004 | Clarke et al. | 131/339 |
| 6,935,346 | B2 | * | 8/2005 | Bushby et al. | 131/334 |

FOREIGN PATENT DOCUMENTS

| | | | | |
|---|---|---|---|---|
| DE | 879823 | | | 6/1953 |
| DE | 19753793 | | | 5/1999 |
| EP | 578385 | A1 | * | 1/1994 |
| EP | 0679343 | | | 11/1995 |
| GB | 1019092 | | | 2/1966 |
| GB | 1372692 | | | 11/1974 |
| GB | 2095532 | | | 10/1982 |
| GB | 2111817 | | | 7/1983 |
| JP | 7265051 | | | 10/1995 |
| WO | WO 00/53037 | | | 9/2000 |
| WO | WO 01/41590 | | | 6/2001 |
| WO | 0224005 | A2 | | 3/2002 |

OTHER PUBLICATIONS

Browne, Colin L. The Design of Cigarettes. 1981: Celanese Corporation. Second edition. pp. 47-59.*

* cited by examiner

FILTER TIP CIGARETTES AND METHOD OF MANUFACTURING SAME

CROSS REFERENCE TO PRIOR APPLICATION

This application is a national stage filing (35 U.S.C. 371) of PCT/GB2003/003430, filed on Aug. 7, 2003, which claims priority to and benefit from German Application No. DE10236655.1, filed on Aug. 9, 2002, currently pending.

The invention relates to a filter-tip smoking articles and in particular, but not exclusively, to cigarettes, and to a method of manufacturing same.

Figure 1:
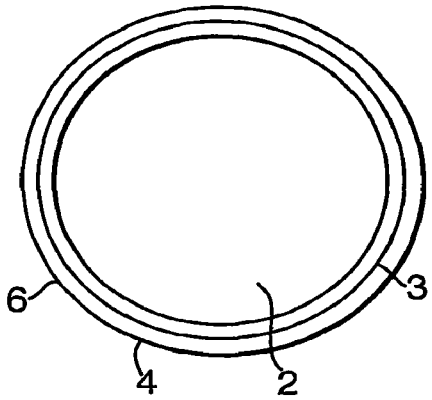
Figure 3:
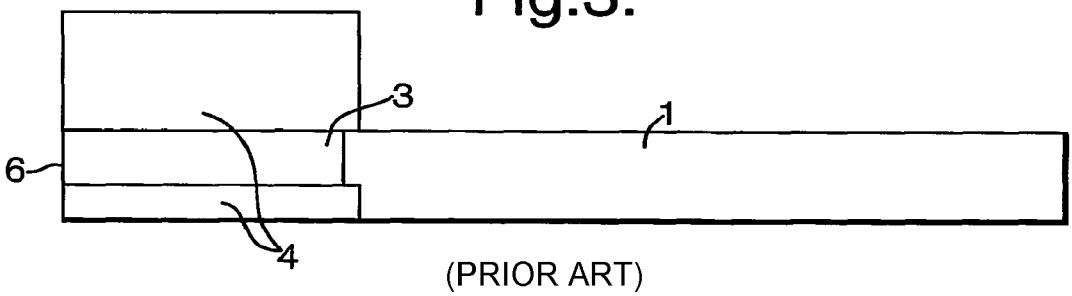
Figure 5:
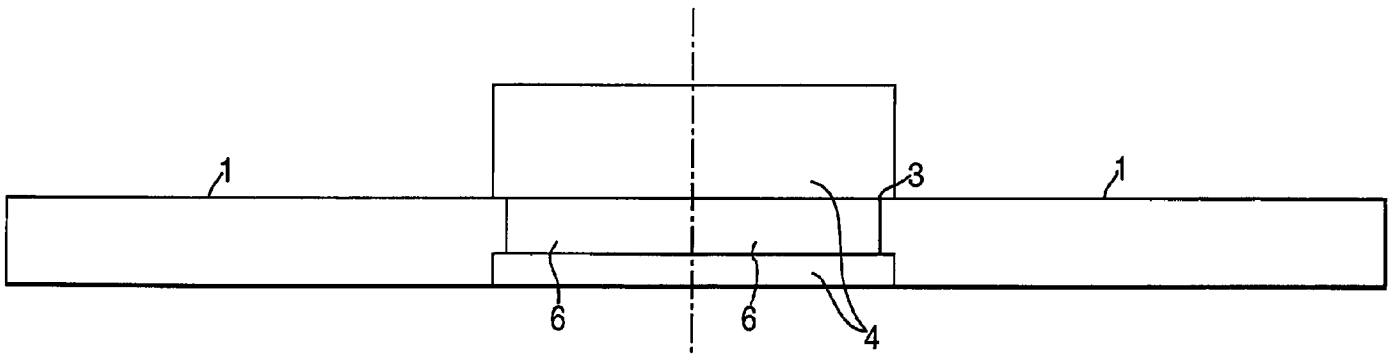
Fig.5. (PRIOR ART)

Conventional filter-tip smoking articles, such as the cigarettes shown in FIGS. 1, 3 and 5 hereof, consist of a tobacco rod 1 wrapped in cigarette paper and a filter 6.

Cigarette filters are known in many different embodiments and generally consist of three components, namely:

a) filtration material 2, usually of cylindrical shape, and being for example, cellulose acetate, paper, tobacco or similar materials or a combination of these materials, including perhaps additional material for filtering particular phases of the smoke, such as activated charcoal, for example, b) a paper 3 wrapped around and stabilising the filter, also known as plugwrap, and c) a filter tipping paper 4 (known hereafter as 'tipping' or 'tipping paper').

The plugwrap is placed around the filtration material 2 and glued during the manufacture of the filter in order to fix the structure of the filter and to ensure that the filter finished thus far can be transported without problem to the filter assembler, which is generally located immediately attached to the cigarette-manufacturing machine which supplies the tobacco rod.

As can be seen from FIG. 3, the tipping is, as a rule, about 4 mm longer than the filter itself and is applied to the filter in the manufacture of the cigarette in the filter assembler. Because of its greater length the tipping overlaps a part of the tobacco rod and in this way interattaches the filter to the cigarette paper wrapped tobacco rod.

Besides fulfilling this bonding function the tipping must also be resistant to the moisture derived from the lips of the smoker, optionally be provided with ventilation holes, and finally satisfy certain design requirements by suitable fashioning, for example, printing.

In modern high-speed filter assembling machines the procedure shown in FIG. 5 is used, making use of a double filter consisting of two filters 6 joined together. This double filter is wrapped in a single piece of tipping 4 which projects slightly at the ends over the two filters 6, covering the plugwrap, so that the two tobacco rods 1 can be attached to the two ends of this double filter by the technique described above. After bonding the double filter to the two tobacco rods 1 the double filter is separated into two individual filters 6 along the dotted line shown in FIG. 5 to produce two filter-tip cigarettes.

A disadvantage of these known filter-tip cigarettes is the relatively expensive construction with the double wrapping of the filtration material 2 with plugwrap 3 and the tipping 4.

Consequently it is an object of the present invention to provide a filter-tip cigarette of the given type and a method for its manufacture in which the above-mentioned disadvantage is overcome.

In particular, a filter-tip cigarette is proposed which, through a modification to the structure, economises on material without requiring serious changes to the manufacturing process and to the materials used.

It is a further object to provide a filter-tip cigarette which negates the need to provide two or more different filter element wrapping materials to the cigarette.

The present invention provides a filter cigarette comprising a tobacco rod wrapped in a wrapper and a filter joined thereto, the filter being wrapped along its length in a tipping paper or other wrapper being other than a plugwrap, and a strip of material covering the joint abutment of the tobacco rod and the filter, thus connecting the filter and the tobacco rod.

An advantage achieved by the invention is that in the manufacture of the filter no plugwrap is used but, instead, the filter is wrapped with tipping paper or other wrapper immediately on the filter manufacturing machine. The filter rods so manufactured are sufficiently mechanically stable and can be transported in the conventional manner, for example, pneumatically, to the filter assembler. As used herein below the term 'tipping wrapper' or 'tipping' means tipping wrapper or other wrapper (other than a plugwrap), if not so specified.

Bonding or interattaching of the filter to the tobacco rod in the present invention is effected not with tipping but an additional narrower strip of material is used for this which covers the seam between filter and tobacco rod by a few millimetres on both sides.

Preferably this strip can likewise consist of the material from which conventional tipping paper is made or may differ from it in design or be of different material, for example, paper which does not have to meet the requirements of tipping paper, or indeed may even be a foil.

The saving in material which is achieved despite the additional strip of material is a result of the elimination of the plugwrap in conjunction with the reduced width of the relatively expensive tipping paper, which is no longer required to overlap the tobacco rod, i.e. the length of the tipping paper or other wrapper now corresponds to exactly the length of the filter.

Figure 6:
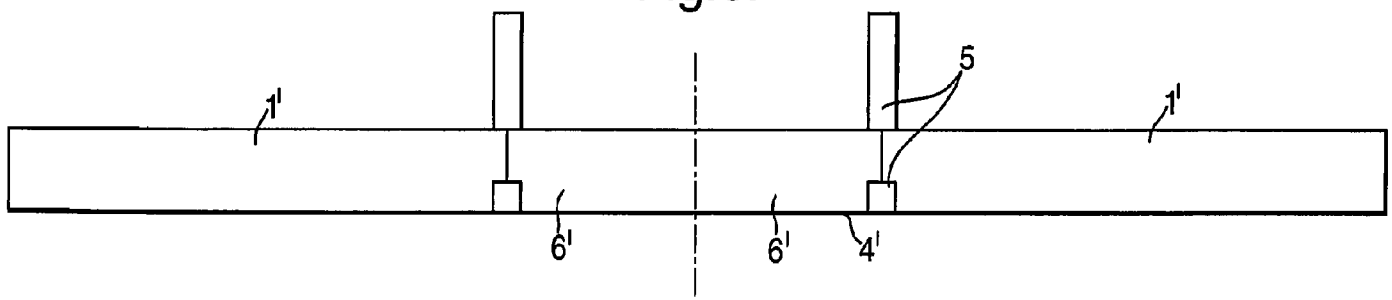

This novel filter cigarette can be manufactured on existing cigarette-making machines, in particular existing filter assemblers, where the double width tipping (see FIG. 5) can be replaced by two strips of material which are fed at the appropriate distance from one another to the two join locations between the double-length filters and the wrapped tobacco rods (see FIG. 6). A very similar process is described in UK Patent Specification No. 1,019,092. No mention is made therein of the removal of plugwrap from, the filter element.

The strip of material serving to bond together the filter and the tobacco rod should preferably have a width of from 4 to 12 mm, and more preferably 6 to 10 mm, in order to guarantee an optimal compromise between a stable joint on the one hand and the minimal outlay on material on the other.

For this it is sufficient, in accordance with experience, if the strip of material is a maximum of 20% of the length of the filter, more particularly 15% of the length of the filter, where the degree of overlap of the strip of material is preferably symmetrical for filter and tobacco rod, i.e. the strip of material extends over filter and tobacco rod equally on both sides.

If tipping paper or other wrapper provided with ventilation openings is used then ventilated filter-tip cigarettes can be manufactured in accordance with present day practice. For this it is possible either to use porous tipping paper or other wrapper, or the tipping paper or other wrapper is provided with ventilation openings during or after its manufacture. As an alternative to this it is also possible, in accordance with the practice frequently employed nowadays, to provide the already finished filter-tip cigarette with ventilation openings in the tipping paper or other wrapper, either mechanically or by laser perforation, i.e., for example, the use of pre-perforated tipping paper.

Naturally porous tipping paper or other wrapper is desirable to maintain a consistent level of ventilation. Glue application would only be required on the lap seam of the paper wrapping the filter, with the possibility of a glue 'anchor line' in addition to hold the tipping paper in place. Reduced usage of glue provides for minimal effect on the air permeability of the paper, giving greater consistency.

An alternative other wrapper is a barrier material which has a pore size of less than about 5 μm. Preferably the pore size is less than about 1 μm and even more preferably is less than about 0.1 μm. Such a material has a high diffusion coefficient (moles/sec/$m^2$) for vapour phases for a given permeability.

Advantageously the barrier means may be formed from a flexible or a rigid material. Advantageously the barrier means may be formed from a vapour porous polymeric material. Preferably the polymeric material may be selected from the group consisting of polyvinylidene fluoride, polyvinyl chloride, polycarbonate, nylon, Teflon™ (PTFE), cellulose acetate or nitrocellulose. Other suitable polymeric materials will be well known to the skilled artisan The invention has particular application in a number of different embodiments of the invention. The use of particulate materials in the filtration material of filters to reduce vapour phase components of smoke is well known. A more recent concept is the introduction of the particulate material onto a wrapper of the filter element, see, for example, the process described in our co-pending UK Patent Application No. 0310034.4. Most usually the wrapper to which the particulate matter is applied is the plugwrap of the filter element, but in some instances it could be another wrapper. The present invention is of particular usefulness in those instances where a smoking article usually utilises a porous plugwrap, particularly plugwrap having a permeability of >1,500 Coresta Units (CU), preferably >3,000 CU, more preferably >10,000 and may be as high as 20,000 CU. The application of an adhesive to the porous plugwrap results in bleed-through of the adhesive, which is detrimental to the machinery itself, the process, the final product and its performance. The present invention represents a useful solution to this problem.

Preferably particulate material is applied at a predetermined location on the tipping paper or another wrapper using adhesive, the tipping paper or wrapper being wrapped around the length of the filter element. Preferably the length is the full length of the filter element.

Even more preferably the predetermined location is determined in registration with the position of perforations on a pre-perforated wrapper. The perforations may be circumferentially or longitudinally arranged with respect to the filter. Advantageously the perforations are located upstream of the predetermined location of the particulate material. Most advantageously the perforations are also located downstream of the strip of material interattaching the filter and tobacco rod.

Preferably the particulate material is one or more of activated charcoal or activated carbon, molecular sieves or other suitable vapour phase absorbents.

The tipping or other wrapper is advantageously of an inherent permeability within the range of 50-500 CU, and is preferably greater than 150 CU. The basis weight of the tipping or other wrapper is advantageously within the range of 25-45 g/$m^2$, and is preferably >30 g/$m^2$. When the tipping is perforated advantageously the level of ventilation is between 50-5,000 CU/cm length in the area of perforation.

The basis weight of the strip of material is advantageously in the range of 20-50 g/$m^2$.

A further advantage that the present invention provides is a solution with respect to the joining of elements of a smoking article that may not be conventional. For example, the wrapper described in our pending International Patent Application, Publication No. WO 01/41590 is comprised of a particulate ceramic filler of predefined shape and a binder (either inorganic or organic), with optional ash improver and/or burn additive. The ceramic filler may be present in the range of 50-95% by weight of the wrapper and advantageously has a particle size in the range of 2-90 μm and preferably a mean particle size of about 50 μm. Preferably the filler is alumina or another similar thermally stable metal oxide or metal salt. In view of the more fragile nature of such a wrapper it may be advantageous to interattach the tobacco rod enclosed in this wrapper to a filter by a method that does not require rolling of the whole wrapped tobacco rod on a rolling plate as in conventional methods of interattaching a tobacco rod and filter. There is thus provided a filter tip cigarette with a non-conventional wrapper attached to a filter without plugwrap using a narrow strip of material.

The present invention provides a method of producing filter tip cigarettes comprising a filter wrapped in a tipping paper or other wrapper being other than plugwrap and a tobacco rod wrapped in a wrapper, the tipping paper or other wrapper of the filter having particulate material attached thereto, the method comprising the steps of supplying filter tow to a filter making machine, supplying the tipping paper or other wrapper to a particulate material applying station located at the filter making machine, at which station particulate material is attached to the tipping or other wrapper, wrapping the filter tow with the treated wrapper and cutting the wrapped filter tow into unit filter lengths, thereafter supplying the cut lengths to a filter tip assembly machine to produce filter tip cigarettes.

The method preferably comprises supplying inherently porous or perforated tipping or other wrapper to the filter making machine.

A further use of the invention may be in factories producing low volumes of various filter tipped products. Often there is a need to supply filter elements having different filter ventilation levels to different making machines. The present invention would enable a filter manufacturer to produce filters wrapped in a wrapper other than plugwrap (as outlined above). The wrapper may be pre-perforated or the wrapped filter element can be perforated online. Successive batches of filters can thus be produced to different ventilation levels, then supplied to a succession of cigarette making machines using strips of material for interattaching a tobacco rod and filter elements, each machine requiring filters of a particular ventilation level. There are thus advantages in cost savings by negating the use of plugwrap and an increase in filter machinery productivity.

The present invention provides a method of reducing filter-tip cigarette manufacturing cost, the method comprising providing batches of filters wrapped along their length in a tipping paper or other wrapper being other than plugwrap, and each batch of wrapped filters having a predetermined ventilation level and being sourced from the same filter making machine, and supplying the batches of ventilated wrapped filters to respective filter tip assembly machines capable of producing a double cigarette assembly of a double filter between two wrapped tobacco rods, each filter tip assembly machine utilising two narrow strips of material to interattach the double filter and two wrapped tobacco rods, cutting the double filter to provide two filter tip cigarettes, and thereby producing batches of differently ventilated filter tip cigarettes from a plurality of filter tip assembly machines.

A further use is in the prevention of hot coal fallout which occurs as the cigarette burns down towards the filter and the tipping paper. The strip of material may be treated with material designed to help prevent hot coal fall out as the cigarette burns down to the finish, for example material designed to cause extinction of the cigarette, or alternatively, the strip of material may be a heavy weight, low permeability paper that causes a reduction in burn rate and hence extinguishment of the cigarette. Typical paper characteristics of such a wrapper are an inherent permeability of 3 CU or less, preferably 2 CU or less, more preferably 1 CU or less, and a basis weight of in a range of 40-45 g/m$^2$. Suitable treatments include the use of burn retardants, such as those known to the man skilled in the art, for example, monoammonium phosphate.

The strip of material may alternatively be treated with thermochromic material that will undergo a colour change to reveal a message or an indicia as temperature increases. A further alternative is the printing or sticking on of promotional material thereupon.

Advantageously the strip of material is self adhesive, which eliminates the problems that can be caused with glue applicators on filter tipping machines.

Figure 2:
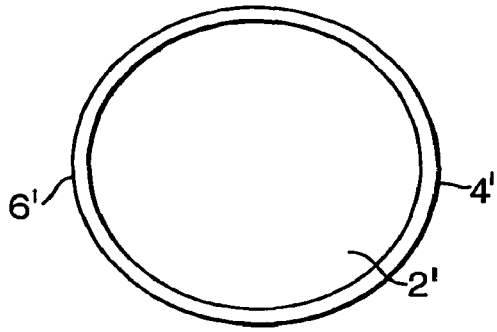
(PRIOR ART) Fig.2.
Figure 4:
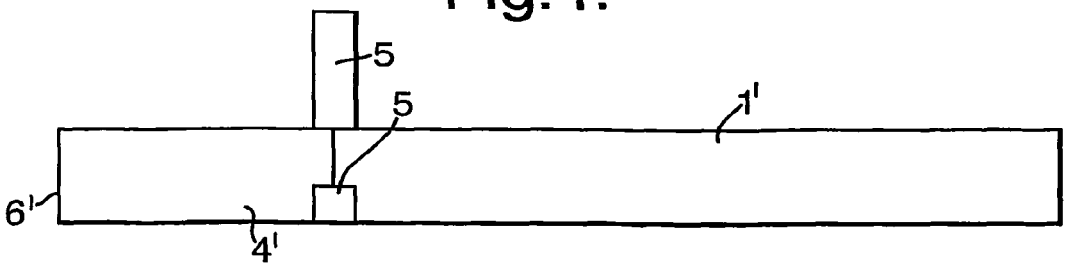
(PRIOR ART) Fig.4.
Figure 7:
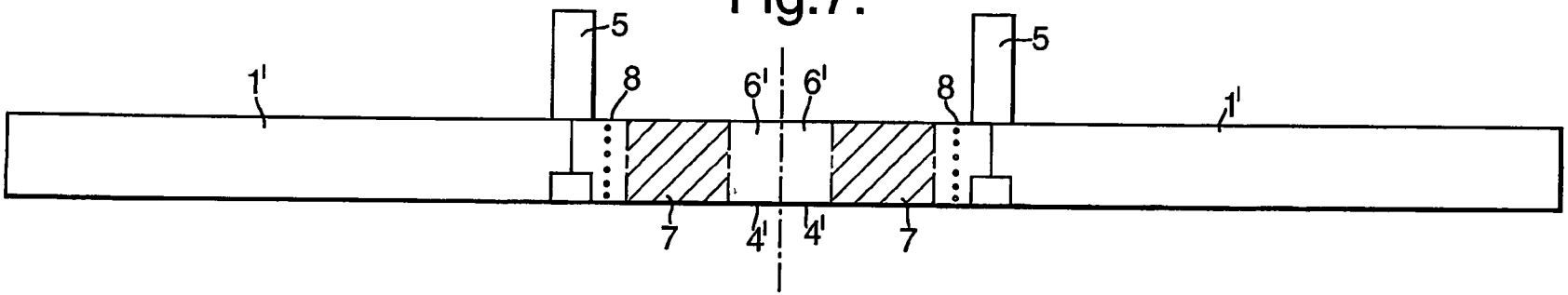

The invention is described in more detail by means of examples with reference to the attached schematic drawings in which:

FIG. 1 is a cross-section transverse to the longitudinal axis of a filter of a cigarette in accordance with the state of the art, FIG. 2 is a cross-section transverse to the longitudinal axis of a filter of a cigarette in accordance with the invention, FIG. 3 is a longitudinal cross-section of a filter-tip cigarette using the filter of FIG. 1 in accordance with the state of the art, FIG. 4 is a view corresponding to FIG. 3 of a filter-tip cigarette in accordance with the invention, FIG. 5 is a schematic view of a 'double cigarette' joined through a double filter in accordance with the state of the art, FIG. 6 is a view corresponding to FIG. 5 of a 'double cigarette' in accordance with the invention, and FIG. 7 is a longitudinal cross section of a further embodiment of the filter tip cigarette of the invention.

The conventional filter-tip cigarette represented in FIGS. 1, 3 and 5 has already been described in detail above. These Figures are contrasted with the filter-tip cigarettes in accordance with the invention in FIGS. 2, 4 and 6.

As can be seen in FIGS. 2 and 4, the filter-tip cigarette in accordance with the invention consists of a tobacco rod 1' wrapped in cigarette paper and a filter 6' with a filtration material 2' and with a wrapper 4' of tipping paper. The tipping paper 4' extends over the entire length of the filter 6', but not beyond it, and thus also wraps the whole circumference of the filtration material 2'. A strip of material 5 covers the join abutment between the tobacco rod 1' and the filter 6', as is clear from FIG. 4, and also extends slightly over the outer circumference of the tobacco rod 1' and filter 6', and serves to bond together the tobacco rod 1' wrapped in cigarette paper with the filtration material 2' wrapped in tipping paper 4' and hence with the filter 6'. The strip of material 5 should have a width of 4 to 12 mm, more particularly 6 to 10 mm. Good results have been achieved with a width of about 8 mm.

This approximates to the requirement that the strip of material 5 overlap by a maximum of 20%, more particularly less than 15% of the length of the filter 6'. As ban be further seen from FIG. 4, the degree of overlap of the strip of material 5 is symmetrical for filter 6' and tobacco rod 1', i.e. the strip of material 5 covers the same area on both sides over the filter 6' and the tobacco rod 1'.

Although not illustrated in FIGS. 2, 4 and 6, the tipping paper 4' can be porous or provided with ventilation openings in order to enable ventilation of the cigarette.

As an alternative it is also possible to provide finished filter-tip cigarettes already provided with filters with ventilation openings, either mechanically or by laser perforation.

As the material for the strip 5 it is possible to employ all of the materials used in cigarette manufacture, such as tipping paper, other papers, such as, for example cigarette paper, foil, etc. The strip of material 5 may be printed or unprinted. The strip of material may also be treated with material designed to help prevent hot coal fall out as the cigarette burns down to the finish.

It is also not necessary to make any changes to the filtration material, that is, all conventional filtration materials, such as cellulose acetate, paper or tobacco, with or without additives such as activated charcoal, additives, etc., can be considered.

As can be seen from FIG. 6 filter-tip cigarettes in accordance with the invention may be manufactured essentially by the same process as is shown in FIG. 5, namely with a double filter 6', to the ends of which two tobacco rods 1' are attached by means of two strips of material 5. The double filter is then divided in the middle to produce two filter-tip cigarettes of filters 6' and tobacco rods 1.

FIG. 7 shows a filter tip cigarette in accordance with the invention in which the tipping 4' has been treated with adhesive at a predetermined location 7 and then a particulate material has been adhered thereto before wrapping around the filtration material of filter 6'. Upstream of each location 7 of particulate material are ventilation perforations 8 which in this instance were present in the tipping before the tipping was wrapped around the filtration material. The perforations may be produced after application of the particulate material, but most preferably before application of particulate material. The location of the particulate material is in register with the perforations, and in registration with the strips of material 5. The strips of material 5 join each tobacco rod with the respective ends of the double filter.

The invention claimed is:

1. A filter cigarette comprising a tobacco rod wrapped in a wrapper and a filter made of filtration material joined thereto forming a joint abutment, said filtration material of said filter being wrapped along the length thereof only in a first tipping paper which is in direct contact with said filtration material and which does not extend over said tobacco rod, and a strip of material covering said joint abutment and only areas closely adjacent said joint abutment of the tobacco rod and the filter, thus connecting the filter and tobacco rod, wherein the inherent permeability of the first tipping paper is 50-500 CU.

2. A filter cigarette according to claim 1, wherein the strip of material is a second tipping paper.

3. A filter cigarette according to claim 1, wherein the strip of material is a foil material.

4. A filter cigarette according to claim 1, wherein the strip of material is printed or imprinted.

5. A filter cigarette according to claim 1, wherein the strip of material has a width of 4 to 12 mm.

6. A filter cigarette according to claim 5, wherein the strip of material has a width of 6 to 10 mm.

7. A filter cigarette according to claim 1, wherein the strip of material extends over a maximum of 20% of the length of filter.

8. A filter cigarette according to claim 7, wherein the strip of material extends over less than 15% of the length of filter.

9. A filter cigarette according to claim 1, wherein the degree of coverage of the strip of material interattaching the filter and tobacco rod is equal.

10. A filter cigarette according to claim 1, wherein the basis weight of the first tipping paper is 25-45 g/m$^2$.

11. A filter cigarette according to claim 1, wherein the tobacco rod wrapper is a wrapper comprising a particulate ceramic filler of predefined shape and a binder, with optional ash improver and/or burn additive.

12. A filter cigarette according to claim 11, wherein the ceramic filler is present in the range of 50-95% by weight of the wrapper.

13. A filter cigarette according to claim 11, wherein the ceramic filler has a particle size in the range of 2-90 μm.

14. A filter cigarette according to claim 13, wherein the ceramic filler has a mean particle size of about 50 μm.

15. A filter cigarette according to claim 11, wherein the ceramic filler is alumina or another similar thermally stable metal oxide or metal salt.

16. A method of reducing filter-tip cigarette manufacturing cost, the method comprising providing batches of double filters made of filtration material and wrapped along their length only in a tipping paper in a manner such that said tipping paper does not extend beyond the ends of each such double filter, said tipping paper having an inherent permeability of 50-500 CU and which is in direct contact with said filtration material and each batch of wrapped double filters being sourced from the same filter making machine, and supplying the batches of such wrapped double filters to respective filter tip assembly machines capable of producing a double cigarette assembly of a double filter positioned between two wrapped tobacco rods, and wherein the said tipping paper does not extend over the said wrapped tobacco rods, each filter tip assembly machine utilizing two narrow strips of material to interattach the double filter and two wrapped tobacco rods, cutting the double filter to provide two filter tip cigarettes, and thereby producing batches of filter tip cigarettes from a plurality of filter tip assembly machines.

17. A method of producing filter tip cigarettes which comprise a filter made of filtration material and a tobacco rod wrapped in a wrapper, the tipping paper of the filter having particulate material attached thereto, the method comprising the steps of supplying filter tow to a filter making machine, supplying the tipping paper having an inherent permeability of 50-500 CU to a particulate material applying station located at the filter making machine, at which station particulate material is attached to the tipping paper, wrapping the filter tow only with the treated tipping paper along the length thereof so that the treated tipping paper is in direct contact with the filter tow and so that the treated tipping paper does not extend beyond the ends of the filter tow, and cutting the wrapped filter tow into unit filter lengths, thereafter supplying the cut lengths to a filter tip assembly machine to produce filter tip cigarettes.

18. A filter cigarette according to claim 1, wherein a particulate material is applied at a predetermined location on said first tipping paper.

19. A filter cigarette according to claim 18, wherein said particulate material is one or more of activated charcoal, activated carbon and molecule sieves.

20. A filter cigarette according to claim 1, wherein the basis weight of the strip of material is in the range of 20-50 g/m$^2$.

* * * * *